US005332415A

United States Patent [19]

Kita

[11] Patent Number: 5,332,415

[45] Date of Patent: Jul. 26, 1994

[54] COMPACTED AND CONSOLIDATED ALUMINUM-BASED ALLOY MATERIAL AND PRODUCTION PROCESS THEREOF

[75] Inventor: Kazuhiko Kita, Uozu, Japan

[73] Assignee: Yoshida Kogyo K.K., Tokyo, Japan

[21] Appl. No.: 930,734

[22] Filed: Aug. 14, 1992

[30] Foreign Application Priority Data

Sep. 5, 1991 [JP] Japan ..... 3-225975

[51] Int. Cl.[5] ..... B22F 3/00; C22C 21/00

[52] U.S. Cl. ..... 75/249; 75/351; 148/403; 420/551; 419/1; 419/66; 419/67

[58] Field of Search ..... 75/249, 954, 351, 343; 419/66, 67, 1; 420/550, 551, 552; 148/437, 549, 550, 403; 428/548

[56] References Cited

U.S. PATENT DOCUMENTS

| | | | |
|---|---|---|---|
| 4,347,076 | 8/1982 | Ray et al. | 75/0.5 R |
| 4,799,978 | 1/1989 | Langenbeck et al. | 148/437 |
| 4,865,666 | 9/1989 | Kumar et al. | 148/437 |
| 4,866,479 | 9/1989 | Tsukuda et al. | 355/211 |
| 5,000,781 | 3/1991 | Skinner et al. | 75/249 |
| 5,530,084 | 10/1991 | Masumoto et al. | 148/11.5 |

FOREIGN PATENT DOCUMENTS

| | | |
|---|---|---|
| 0303100A1 | 2/1989 | European Pat. Off. . |
| 1-275732 | 11/1989 | Japan . |

OTHER PUBLICATIONS

Journal of Materials Science Letters, vol. 7, No. 8, Aug. 1988, pp. 805–807. T. An-Pang et al, "Ductile Al-Ni--Zr Amorphous Alloys with High Mechanical Strength".

Patent Abstracts of Japan, vol. 14, No. 043 (C-681) Jan. 26, 1990. JP-A-12 75 732.

*Primary Examiner*—Donald P. Walsh
*Assistant Examiner*—Ngoclan T. Mai
*Attorney, Agent, or Firm*—Flynn, Thiel, Boutell & Tanis

[57] ABSTRACT

The present invention provides a compacted and consolidated aluminum-based alloy material which has been obtained by compacting and consolidating a rapidly solidified material having a composition represented by the general formula: $Al_aNi_bX_c$ wherein X is one or two elements selected from Zr and Ti and a, b and c are, in atomic percentages, $87.5 \leqq a \leqq 92.5$, $5 \leqq b \leqq 10$, and $0.5 \leqq c \leqq 5$; and a production process comprising melting a material of the above composition; quenching and solidifying the resultant molten material into powder or flakes; compacting, compressing, forming and consolidating the powder or flakes by conventional plastic working. The consolidated material of the present invention has elongation (toughness) sufficient to withstand secondary working, even when secondary working is applied. Moreover, the material allows the secondary working to be performed easily while retaining the excellent properties of its raw material.

8 Claims, 4 Drawing Sheets

COMPACTED AND CONSOLIDATED ALUMINUM-BASED ALLOY MATERIAL AND PRODUCTION PROCESS THEREOF

BACKGROUND OF THE INVENTION

1. Field of the Invention

The present invention relates to a compacted and consolidated aluminum-based alloy material having not only a high strength but also an elongation sufficient to withstand practically-employed working operations, and also to a process for the production of the material.

2. Description of the Prior Art

Aluminum-based alloys having high strength and high heat resistance have been produced to date by liquid quenching or the like. In particular, the aluminum alloys disclosed in Japanese Patent Application Laid-Open (Kokai) No. HEI 1-275732 and obtained by liquid quenching are amorphous or microcrystalline and are excellent alloys having a high strength, high heat resistance and high corrosion resistance.

The conventional aluminum-based alloys referred to above exhibit a high strength, high heat resistance and high corrosion resistance and are excellent alloys. When they are each obtained in the form of powder or flakes by liquid quenching and the powder or flakes are then processed or worked as a raw material in one way or another to obtain a final product, in other words, the powder or flakes are converted into a final product by primary processing or working, they exhibit an excellent processability or workability. However, to form the powder or flakes as a raw material into a consolidated material and then to work the consolidated material, namely, to subject the consolidated material to secondary working, there is still room for improvement in their workability and also in the retention of their excellent properties after working.

SUMMARY OF THE INVENTION

An object of the present invention is, therefore, to provide a compacted and consolidated aluminum-based alloy material having a particular composition that permits easy working upon subjecting the material to secondary working (extrusion, cutting, forging or the like) and allows the retention of the excellent properties of the material even after working.

The present invention provides a compacted and consolidated aluminum-based alloy material which has been obtained by compacting and consolidating a rapidly solidified material having a composition represented by the general formula: $Al_aNi_bX_c$, wherein X is one or two elements selected from Zr and Ti and a, b and c are, in atomic percentages, $87.5 \leqq a \leqq 92.5$, $5 \leqq b \leqq 10$, and $0.5 \leqq c \leqq 5$.

More preferably, the above consolidated material is formed of a matrix of aluminum or a supersaturated aluminum solid solution, whose mean crystal grain size is 40–1000 nm, and grains made of a stable or metastable phase of various intermetallic compounds formed of the matrix element and the other alloying elements and/or of various intermetallic compounds formed of the other alloying elements are distributed evenly in the matrix, and the intermetallic compounds have a mean grain size of 10–800 nm.

The present invention also provides a process in which a material represented by the above-specified general formula is molten and then quenched and solidified into powder or flakes and, thereafter, the powder or flakes are compacted and then compressed, formed and consolidated by conventional plastic working. In this case, the powder or flakes as the raw material are required to be amorphous, a supersaturated solid solution, or microcrystalline such that the mean crystal grain size of the matrix is not greater than 1000 nm and the mean grain size of intermetallic compounds is 1–800 nm; or to be in a mixed phase thereof. When the raw material is amorphous, it can be converted into such a microcrystalline or mixed phase as defined above by heating it to 50° C. to 400° C. upon compaction.

The term "conventional plastic working" as used herein should be interpreted in a broad sense and should embrace pressure forming techniques and powder metallurgical techniques.

DETAILED DESCRIPTION OF THE PREFERRED EMBODIMENTS

Figure 1:
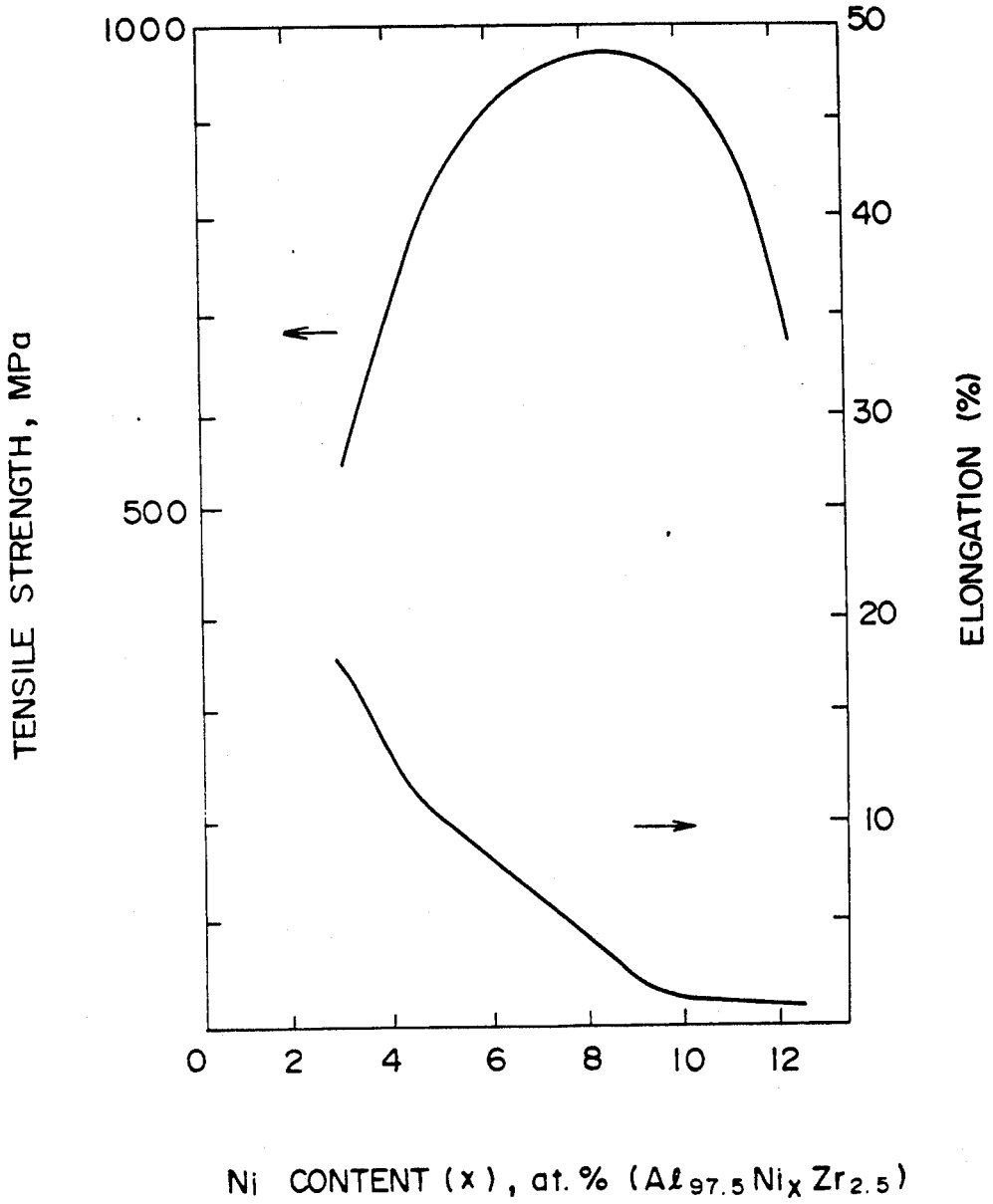
FIG. 1 is a graph showing variations in tensile strength and elongation at room temperature among the consolidated materials of different Ni contents in the example.

The proportions a, b and c are limited, in atomic percentages, to the ranges of 87.5–92.5%, 5–10% and 0.5–5% respectively, in the above general formula, because the alloys within the above ranges have higher strength than conventional (commercial) high-strength aluminum alloys over the temperature range of from room temperature to 200° C. and are also equipped with a ductility sufficient to withstand practically-employed working.

In the consolidated alloy material according to this invention, Ni is an element having relatively small ability to diffuse into the A matrix and is distributed as fine intermetallic compounds in the Al matrix. Ni is therefore effective not only in strengthening the matrix but also in inhibiting growth of crystal grains. In other words, Ni improves the hardness, strength and rigidity of the alloy to significant extents, stabilizes the microcrystalline phase at elevated temperatures, to say nothing of room temperature, and imparts heat resistance.

On the other hand, element X stands for one or two elements selected from Zr and Ti. It is an element having a small ability to diffuse in the Al matrix. It forms various metastable or stable intermetallic compounds, thereby contributing to the stabilization of the microcrystalline structure.

In the consolidated aluminum-based alloy material according to the present invention, the mean crystal grain size of the matrix is limited to the range of 40–1000 nm for the following reasons. Mean crystal grain sizes of the matrix smaller than 40 nm are too small to provide a sufficient ductility, despite providing a high strength. To obtain ductility required for conventional working, a mean crystal grain size of the matrix of at least 40 nm is therefore needed. If the mean crystal grain size of the matrix exceeds 1000 nm, on the other hand, the strength drops abruptly, thereby making it impossible to obtain a consolidated material having a high strength. To obtain a consolidated material having a high strength, a mean crystal grain size of the matrix not greater than 1000 nm is needed. Further, the mean grain size of the intermetallic compounds is limited to the range of 10–800 nm because intermetallic compounds with a mean grain size outside the above range cannot serve as strengthening elements for the Al matrix. If the intermetallic compounds have a mean grain size smaller than 10 nm, they do not contribute to the strengthening of the Al matrix and, if they are present in the state of a solid solution in the matrix in an amount greater than that needed, there is the potential problem of embrittlement. Mean grain sizes greater than 800 nm, on the other hand, result in unduly large grains distributed in the Al matrix so that the Al matrix cannot retain its strength and the intermetallic compounds cannot serve as strengthening elements. The restriction to the above ranges, therefore, leads to improvements in Young's modulus, high-temperature strength and fatigue strength.

In the consolidated aluminum-based alloy material according to the present invention, its mean crystal grain size and the dispersion state of the intermetallic compounds can be controlled by choosing suitable conditions for its production. The mean crystal grain size of the matrix and the mean grain size of the intermetallic compounds should be controlled to be small where an importance is placed on the alloy's strength. In contrast, they should be controlled to be large where the alloy's ductility is considered important. In this manner, it is possible to obtain consolidated aluminum-based alloy materials which are suited for various purposes, respectively.

Further, the control of the mean crystal grain size of the matrix to the range of 40–1000 nm makes it possible to impart properties so that the resulting material can be used as an excellent superplastic working material.

The present invention will hereinafter be described specifically on the basis of the following examples.

EXAMPLE 1

Aluminum-based alloy powders having desired compositions ($Al_{92-x}Ni_8Zr_x$) and ($Al_{97.5-x}Ni_xZr_{2.5}$) were produced by a gas atomizing apparatus. Each aluminum-based alloy powder so produced was filled in a metal capsule and, while being degassed, was formed into an extrusion billet. The billet was extruded at 200°–550° C. through an extruder. Mechanical properties (tensile strength and elongation) of the extruded materials (consolidated materials) obtained under the above production conditions are shown in FIG. 1 and FIG. 2, respectively.

As is depicted in FIG. 1, it is understood that the tensile strength of the consolidated material at room temperature increased at Ni contents of 5 at.% and higher but abruptly dropped at Ni contents higher than 10 at.%. It is also envisaged that the elongation dropped at Ni contents higher than 10 at.%, whereby it is seen that the minimum elongation (2%) required for ordinary working operations can be obtained at an Ni content of 10 at.% or lower.

Figure 2:
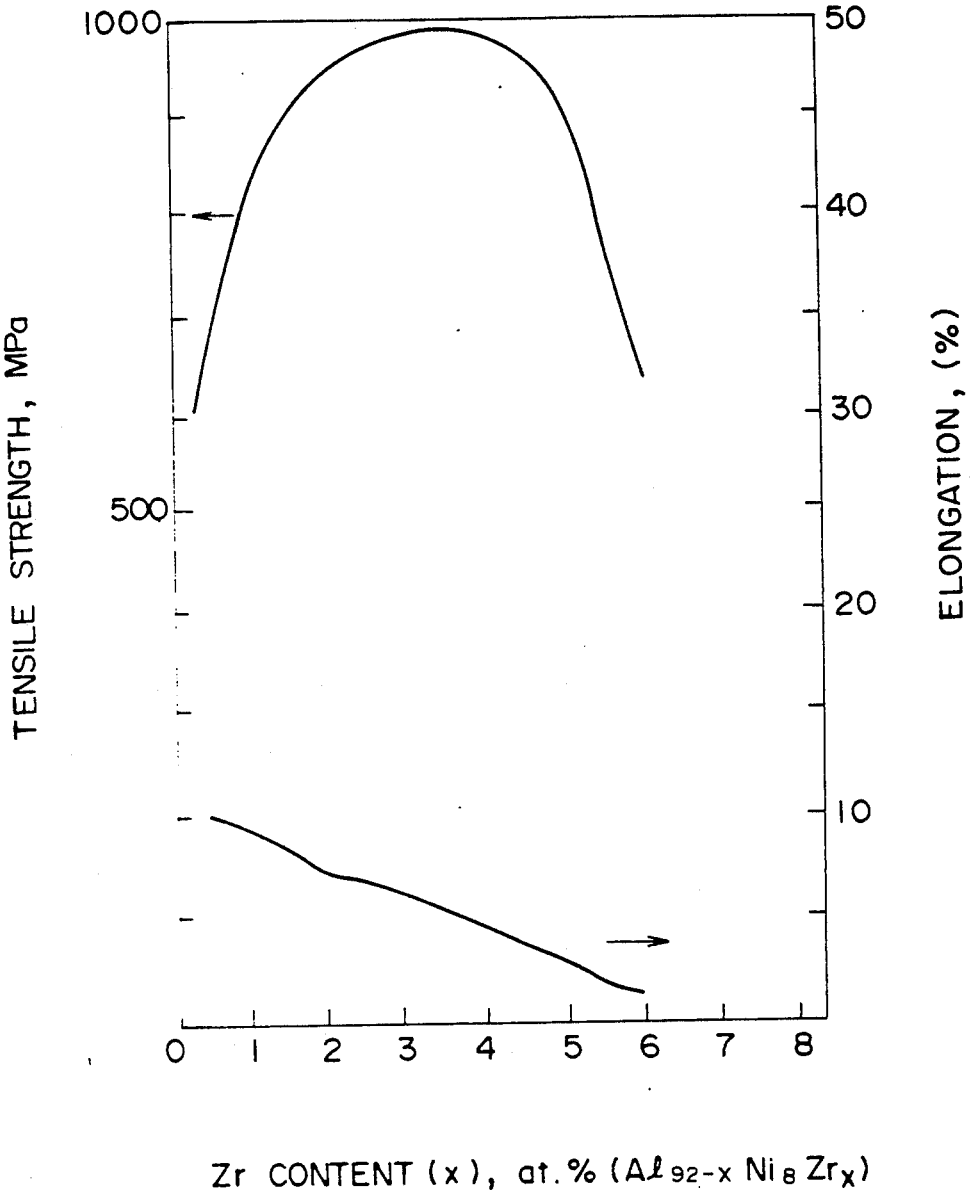
FIG. 2 is a graph depicting variations in elongation and tensile strength at room temperature among the consolidated materials of different Zr contents in the example.

As is illustrated in FIG. 2, it is seen that the tensile strength of the consolidated material at room temperature increased at Zr contents of 0.5 at.% or higher but abruptly dropped at Zr contents higher than 5 at.%. It is also envisaged that the elongation dropped at Zr contents higher than 5 at.%, whereby it is seen that the minimum elongation (2%) required for ordinary working can be obtained at a Zr content of 5 at.% or lower. For the sake of comparison, the tensile strength of a conventional high-strength aluminum-based alloy material (an extruded material of duralumin) was also measured at room temperature. As a result, the tensile strength was found to be about 650 MPa. It is also understood from this value that the above consolidated material of the present invention had an excellent strength at Ni and Zr contents in the above ranges.

With respect to extruded materials (consolidated materials) obtained under the above production conditions, their mechanical properties (tensile strength and elongation) were investigated at 200° C. or lower after they were held at 200° C. for 100 hours. The results are diagrammatically shown in FIG. 3 and FIG. 4, respectively.

Figure 3:
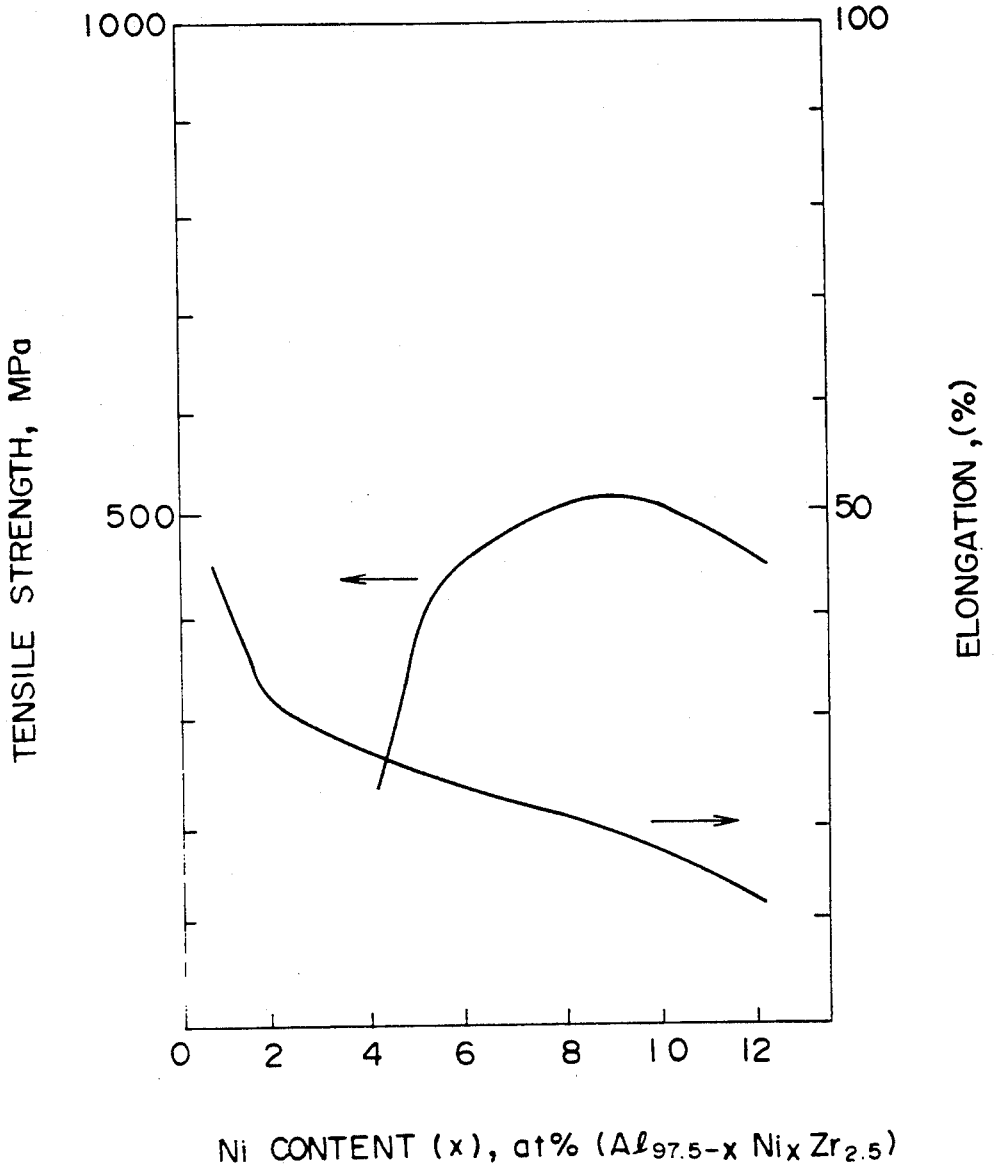
FIG. 3 is also a graph showing variations in elongation and tensile strength among the extruded materials of different Ni contents obtained after having been held at 200° C. for 100 hours in the example.

As is indicated in FIG. 3, it is understood that the tensile strength at 200° C. abruptly dropped at Ni contents less than 5 at.% and gradually dropped when the Ni content exceeded 10 at.%. In contrast, the elongation remained at a large value over the entire range of the Ni content.

Figure 4:
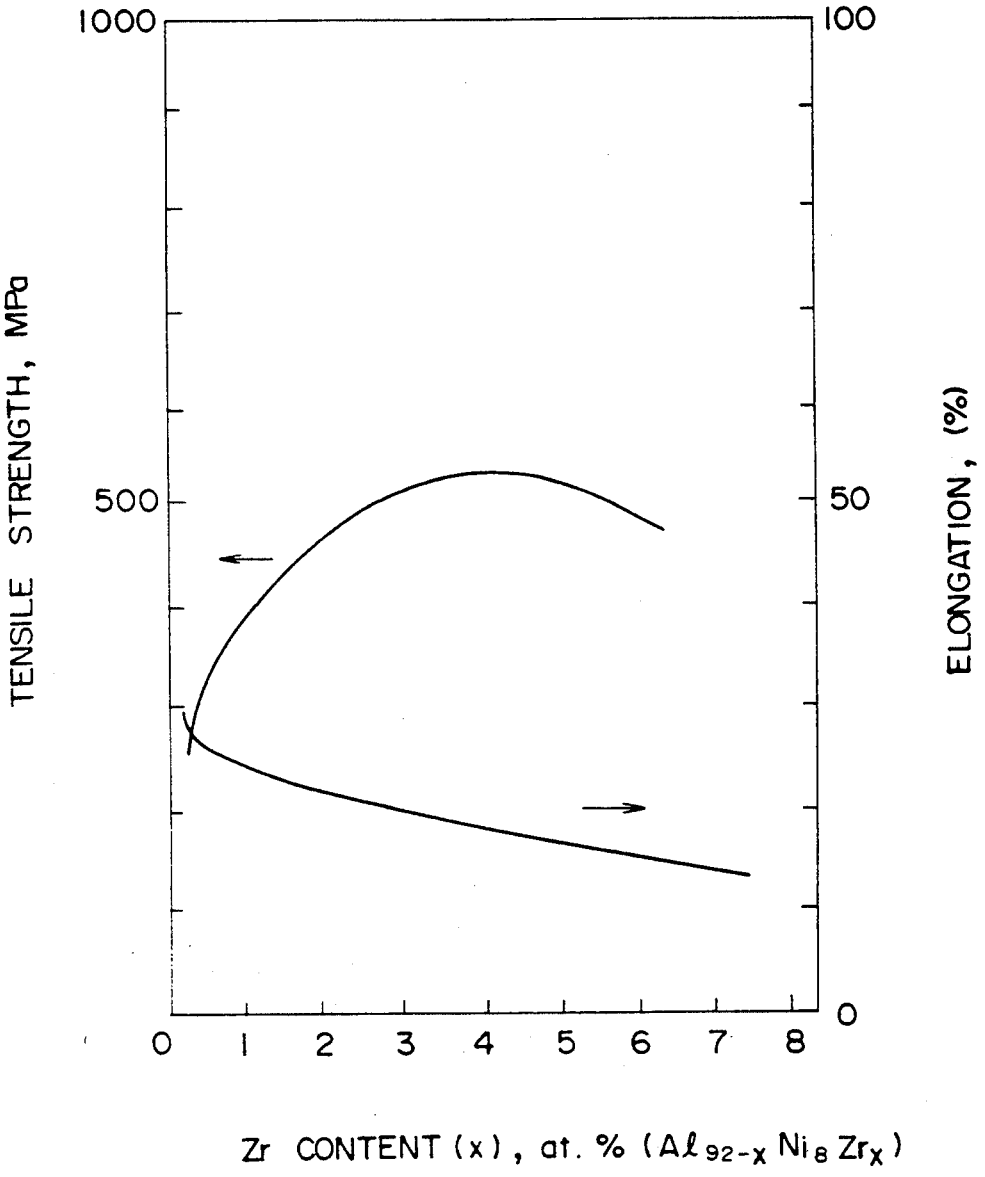
FIG. 4 is a graph illustrating variations in elongation and tensile strength among the extruded materials of different Zr contents after having been held at 200° C. for 100 hours in the example.

As is shown in FIG. 4, it is understood that the tensile strength at 200° C. abruptly dropped at Zr contents lower than 0.5 at.% and gradually dropped when the Zr content exceeded 5 at.%. In contrast, the elongation remained at a large value over the entire range of the Zr content.

For the sake of comparison, the tensile strength of the conventional high-strength aluminum-based alloy material (an extruded material of duralumin) was also measured at 200° C. As a result, its tensile strength was found to be about 200 MPa. From this value, it is understood that the consolidated materials according to the present invention are excellent in strength at 200° C.

EXAMPLE 2

Extruded materials (consolidated materials) having the various compositions shown in Table I were produced in a similar manner to Example 1. Their mechanical properties (tensile strength, Young's modulus, hardness) at room temperature were investigated. The results are also presented in Table 1. It is to be noted that the minimum elongation (2%) required for ordinary working was obtained by all the consolidated materials shown in Table 1.

It is understood from Table 1 that the alloys of the present invention have excellent properties with respect to tensile strength, Young's modulus and hardness.

The Young's modulus of the conventional high-strength aluminum-based alloy material (an extruded material of duralumin) is about 70 (GPa). In comparison with conventional material, the consolidated materials according to the present invention have been found to exhibit the advantages that their deflection and deformation are smaller under the same load.

TABLE 1

| | Composition (at %) | | | Tensile strength | Young's Modulus | Hardness |
|---|---|---|---|---|---|---|
| | Al | Ni | Ti, Zr | (MPa) | (GPa) | (Hv) |
| Invention Sample 1 | Balance | 10 | Zr = 1 | 928 | 99 | 223 |
| Invention Sample 2 | Balance | 9 | Zr = 4 | 983 | 107 | 235 |
| Invention Sample 3 | Balance | 9 | Zr = 2 | 945 | 95 | 217 |
| Invention Sample 4 | Balance | 8 | Zr = 4.5 | 950 | 104 | 200 |
| Invention Sample 5 | Balance | 8 | Zr = 3.6 | 970 | 103 | 212 |
| Invention Sample 6 | Balance | 7 | Zr = 3 | 920 | 91 | 192 |
| Invention Sample 7 | Balance | 6 | Zr = 0.5 | 701 | 89 | 152 |
| Invention Sample 8 | Balance | 5 | Zr = 5 | 742 | 97 | 161 |
| Invention Sample 9 | Balance | 5 | Zr = 3 | 715 | 87 | 155 |
| Invention Sample 10 | Balance | 10 | Ti = 2 | 900 | 92 | 217 |
| Invention Sample 11 | Balance | 9 | Ti = 3 | 933 | 97 | 224 |
| Invention Sample 12 | Balance | 8 | Ti = 4 | 969 | 102 | 232 |
| Invention Sample 13 | Balance | 8 | Ti = 0.5 | 908 | 89 | 197 |
| Invention Sample 14 | Balance | 7 | Ti = 2 | 848 | 82 | 184 |
| Invention Sample 15 | Balance | 6 | Ti = 5 | 788 | 88 | 171 |
| Invention Sample 16 | Balance | 5 | Ti = 3 | 747 | 91 | 162 |
| Invention Sample 17 | Balance | 8 | Zr = 2, Ti = 1.5 | 933 | 105 | 224 |
| Invention Sample 18 | Balance | 7 | Zr = 1, Ti = 1 | 899 | 92 | 195 |
| Invention Sample 19 | Balance | 6 | Zr = 3, Ti = 2 | 816 | 90 | 177 |
| Invention Sample 20 | Balance | 5 | Zr = 1.5, Ti = 2 | 686 | 86 | 149 |

Consolidated aluminum-based alloy materials according to the present invention have an excellent elongation (toughness) so they can withstand secondary working when the secondary working is applied. The secondary working can therefore be performed with ease while retaining the excellent properties of the raw materials as they are. Owing to the inclusion of at least one of Zr and Ti as the element X, the consolidated aluminum-based alloy materials according to the present invention have a large specific strength and, therefore, are useful as high specific-strength materials. In addition, such consolidated materials can be obtained by a simple process, that is, by simply compacting powder or flakes, which have been obtained by quench solidification, and then subjecting the thus-compacted powder or flakes to plastic working.

What is claimed is:

1. A compacted and consolidated aluminum-based alloy material which has been obtained by compacting and consolidating a rapidly solidified material having a composition represented by the general formula: $Al_aNi_bX_c$, wherein X is one or two elements selected from Zr and Ti and a, b, and c are, in atomic percentages, $87 \leqq a \leqq 93.5$. $5 \leqq b \leqq 10$, and $0.5 \leqq c \leqq 5$.

2. A compacted and consolidated aluminum-based alloy material according to claim I, wherein said compacted and consolidated aluminum-based alloy material is formed of a matrix of aluminum or a supersaturated aluminum solid solution, whose mean crystal grain size is 40–1000 nm, and grains made of a stable or metastable phase of various intermetallic compounds formed of the matrix element and the other alloying elements and/or of various intermetallic compounds formed of the other alloying elements and distributed evenly in the matrix; and the intermetallic compounds have a mean grain size of 10–800 nm.

3. A process for the production of a compacted and consolidated aluminum-based alloy material which comprises melting a material having a composition represented by the general formula: $Al_aNi_bX_c$, wherein X is one or two elements selected from Zr and Ti and a, b and c are, in atomic percentages, $87 \leqq a \leqq 93.5$, $5 \leqq b \leqq 10$, and $0.5 \leqq c \leqq 5$; quenching and solidifying the resultant molten material into powder or flakes; compacting the powder or flakes; and then compressing, forming and consolidating the thus-compacted powder or flakes by conventional plastic working.

4. A process for the production of a compacted and consolidated aluminum-based alloy material according to claim 3, wherein said consolidated material is formed of a matrix of aluminum or a supersaturated aluminum solid solution, whose mean crystal grain size is 40–1000 nm, and grains made of a stable or metastable phase of various intermetallic compounds formed of the matrix element and the other alloying elements and/or of various intermetallic compounds formed of the other alloying elements and distributed evenly in the matrix; and the intermetallic compounds have a mean grain size of 10–800 nm.

5. A compacted and consolidated aluminum-based alloy material according to claim 1, wherein X is Ti.

6. A compacted and consolidated aluminum-based alloy material according to claim 1, wherein x is Ti and Zr.

7. a process for the production of a compacted and consolidated aluminum-based alloy material according to claim 3, wherein X is Ti.

8. A process for the production of a compacted and consolidated aluminum alloy material according to claim 3, wherein X is Ti and Zr.

* * * * *